US005700764A

United States Patent [19]

Walters et al.

[11] Patent Number: 5,700,764

[45] Date of Patent: Dec. 23, 1997

[54] LUBRICANT COMPOSITIONS

[75] Inventors: David Kenvyn Walters, Camberley, England; Ian Macpherson, Richmond, Va.

[73] Assignee: Ethyl Petroleum Additives Limited, Bracknell, England

[21] Appl. No.: 646,838

[22] Filed: May 8, 1996

[30] Foreign Application Priority Data

May 22, 1995 [GB] United Kingdom ..... 9510292

[51] Int. Cl.[6] ..... C10M 141/10; C10M 141/08

[52] U.S. Cl. ..... 508/338; 508/339; 508/422; 508/436; 508/437; 508/527

[58] Field of Search ..... 508/436, 437, 508/422, 527, 530, 545, 338, 339

[56] References Cited

U.S. PATENT DOCUMENTS

| | | | |
|---|---|---|---|
| 3,203,896 | 8/1965 | Latos et al. | 508/437 |
| 3,793,199 | 2/1974 | Schlicht | 508/436 |
| 4,080,307 | 3/1978 | Schmidt et al. | 508/422 |
| 4,089,792 | 5/1978 | Lowe | 508/545 |
| 4,161,451 | 7/1979 | Lowe | 508/545 |
| 4,177,153 | 12/1979 | Lowe | 508/545 |
| 4,537,694 | 8/1985 | Horodysky | 508/527 |
| 4,543,195 | 9/1985 | Gangette et al. | 508/459 |
| 4,849,119 | 7/1989 | Horodysky | 508/527 |
| 5,342,531 | 8/1994 | Walters et al. | 508/436 |
| 5,552,068 | 9/1996 | Griffith | 508/437 |

*Primary Examiner*—Ellen M. McAvoy

*Attorney, Agent, or Firm*—Dennis H. Rainear; Thomas Hamilton

[57] ABSTRACT

Lubricants and additive packages that give exceptional performance as heavy duty gear lubricants are described. Four essential oil-soluble additive components are used in combination, viz., a metal-free sulfur-containing antiwear and/or extreme pressure agent having a copper corrosion test activity of not more than 65; a metal-free phosphorus- and nitrogen-containing antiwear and/or extreme pressure agent; an organic carboxylic acid; and an organic amine. Tests comparing the performance of the invention against a commercial premium API GL-5 gear oil additive package selected as the best available package by a well-known OEM have shown the superiority of the present compositions under a number of test conditions.

2 Claims, No Drawings

LUBRICANT COMPOSITIONS

This invention relates to lubricant compositions having improved performance capabilities that persist for long periods of time during use.

There are a number of situations in which there is a desire to utilize a gear lubricant having a prolonged service life. For example, to minimize maintenance costs and equipment downtime, equipment operators such as trucking companies and power station operators desire lubricants that retain their original performance capabilities for prolonged periods of service. Original equipment manufacturers desire lubricants having extended drain capabilities whereby their customers can operate the equipment for longer periods of time or for greater distances before draining the lubricant and replacing it with fresh lubricant. In view of the competitive situations in which they operate, lubricant manufacturers are also desirous of having the ability to provide lubricants having these prolonged service capabilities.

Present-day drainage periods specified by truck manufacturers vary to a large extent depending upon such factors as the manufacturer, the type (severity) of service for which the vehicle is designed, and the gear mechanism involved, e.g., the gear box (which normally is a heavy duty manual transmission), and the gearing for the axle (which normally is gearing for a rear axle). For example, one original equipment manufacturer (OEM) specifies a drainage period of 90,000 kilometers (km) (55,923 miles) for both gear box and axle regardless of service conditions. Another OEM specifies 80,000 km (49,710 miles) for the gear box under normal operating conditions and 40,000 km (24,855 miles) for severe operating conditions, and 60,000 km (37,282 miles) for the axle under both conditions. A third OEM specifies 80,000 km (49,710 miles) for the gear box and 60,000 kin (37,282 miles) for the axle. Another OEM specifies the same drainage periods for both gear box and axle, but the periods differ in relation to type of service. Thus for short haul or long haul service the drainage periods are 120,000 km (74,564 miles). But for severe service the periods are 60,000 km (37,282 miles). Yet another OEM has a more extensive drainage breakdown as follows: for gear boxes without coolers, 45,000 km (27,962 miles) under long haul service, 30,000 km (18,641 miles) under short haul service and 10,000 km (6,214 miles) under severe service; for gear boxes with coolers, 90,000 km (55,923 miles) under long haul service, 60,000 km (37,282 miles) under short haul service and 20,000 km (12,427 miles) under severe service; and for axles, 90,000 km (55,923 miles) for long haul service, 60,000 km (37,282 miles) for short haul service and 20,000 km (12,427 miles) for severe service. Thus in this description of the invention, the prolonged service life as applied to gear oils used in heavy duty vehicles such as in heavy duty tracks, is referred to as "extended drain" which means that the gear mechanisms (gear box and axle) of the vehicle should be capable of operating with a drainage period that is at least 40% longer than that currently specified by the OEM for the particular gear mechanism and type of service involved in the operation of the vehicle. In accordance with preferred aspects of the invention, the extended drain periods for gear oils used in heavy duty vehicles such as in heavy duty trucks should extend for a total of at least 100,000 miles, and desirably as long as 250,000 miles, and even more desirably as long as 500,000 miles before draining and replacing the lubricant. Carried to the extreme, fill-for-life is one ultimate target sought in the marketplace. It is not inconceivable based on studies to date that this target may be achievable pursuant to certain preferred embodiments of this invention.

This invention provides, inter alia, lubricants and lubricant additive packages that can provide prolonged effective service life, such as extended drain and at least in some cases, operation for at least 100,000 miles without replacement of the gear box and/or axle lubricant. In preferred embodiments compositions are provided which are useful as transmission oils for heavy duty service, or as axle oils, and as gear oils for all types of service including heavy duty service. Moreover, this invention makes it possible to provide so-called "total driveline" lubricants whereby the same lubricant composition can be used for operation of both the transmission and the axle or differential gearing system. This invention in other preferred embodiments makes it possible to adjust the frictional properties of the additive complement to compensate for differences in the lubricating qualities of different types of lubricant base stocks. Additionally, this invention enables the achievement of the foregoing advantages with lubricants which are free of metal-containing additive components, or which contain as the only metal-containing additive component(s) thereof, a friction-modifying amount of one or more alkali or alkaline earth metal-containing additive components wherein the total concentration of such metal(s) in the finished oil is kept very low.

As will be shown in greater detail hereinafter, this invention has enabled the provision of lubricant compositions which have been found in heavy duty hypoid gear tests performed by a well-known OEM to extend the effective service life of the gears by at least 100% as compared to the life afforded by the commercial premium grade gear lubricant theretofore selected by that OEM as the best available gear lubricant for heavy duty vehicular service.

In one of its embodiments, this invention provides a lubricant which comprises at least one oil of lubricating viscosity and at least the following additive components:

a) at least one oil-soluble metal-free sulfur-containing antiwear and/or extreme pressure agent having a copper corrosion test activity as described hereinafter of not more than 65;

b) at least one oil-soluble metal-free phosphorus- and nitrogen-containing antiwear and/or extreme pressure agent;

c) at least one oil-soluble organic carboxylic acid; and d) at least one oil-soluble organic amine.

The combination of these particular components enables the provision of lubricants which exhibit a unique combination of performance improvements, including reduced pitting and increased tooth life of gears operated under heavy duty service conditions, lower running temperatures of gear trains during operation, reduced power requirements to operate the gear train, increased phosphorus retention in the lubricant used under heavy duty operation, and improved fuel economy of vehicles in which at least the transmission gear train, and preferably the entire driveline (i.e., the gear box and the axle gearing), is lubricated by a lubricant of this invention.

The lubricants of this invention preferably contain from 0.6 to 3.0 wt % of sulfur as component a), from 0.04 to 0.25 wt % of phosphorus as component b), from 0.07 to 0.50 wt % of said carboxylic acid, and from 0.2 to 0.8 wt % of said amine. Particularly preferred lubricants of this invention contain from 0.70 to 2.5 wt % of sulfur as component a), from 0.05 to 0.2 wt % of phosphorus as component b), from 0.07 to 0.35 wt % of said carboxylic acid, from 0.2 to 0.8 wt % of said amine.

This invention also provides additive packages which can be used, and preferably are used, in the production of the above lubricant compositions. Thus, another embodiment of this invention involves the provision of an additive concentrate which comprises a diluent oil and at least 20% by weight, and preferably at least 50% by weight, and most preferably at least 70% by weight, of additive components, said additive components comprising at least the above components a), b), c), and d). Typical proportions of these components in the concentrate are such that for every 10 parts by weight of component d) in the concentrate, there are in the range of from 4 to 400 parts by weight of sulfur as a), from 0.2 to 50 parts by weight of phosphorus as b), and from 0.5 to 60 parts by weight of c). Preferably, the concentrate is proportioned such that for every 10 parts by weight of component d) in the concentrate, there are in the range of from 7.5 to 150 parts by weight of sulfur as a), from 0.5 to 12.5 parts by weight of phosphorus as b), and from 0.875 to 25 parts by weight of c).

Preferably, the finished lubricant compositions of this invention are ashless or low-ash compositions, that is, they contain, if any, at most 2000 parts by weight of metal introduced as one or more additive components per million parts by weight of base oil ("ppm"), preferably no more than 500 ppm of metal, and most preferably zero to at most 25 ppm of metal introduced as one or more additive components. Accordingly, the additive concentrates of this invention are preferably proportioned such that if one or more metal-containing components (e.g., one or more oil-soluble manganese compounds or complexes and/or metal detergent) are included therein, the additive concentrate when employed in a base oil at the selected or recommended dosage level will yield a finished lubricant having at most 2000 ppm, preferably at most 500 ppm, and more preferably at most 25 ppm of added metal. When one or more metal additives are employed, the metal content thereof most preferably is confined to one or more alkali metals and/or one or more alkaline earth metals. Thus, for example, these particular preferred compositions are zinc-free. Compositions devoid of added metal content are most especially preferred. In this connection, neither boron nor phosphorus is subject to these preferred limitations on metal content, as neither such element is a metal. Thus the mere fact that boron and/or phosphorus components may leave residues during usage, is of no relevance as regards these preferred limitations on metal content.

The most preferred low ash compositions of this invention utilize as the only metal-containing additive component(s) thereof, a friction-modifying amount of one or more metal salts selected from the group consisting of metal carboxylates, metal phenates, metal sulfonates and mixtures thereof in which the metal is alkali metal and/or alkaline earth metal. Normally the friction-modifying amount does not exceed 1500 ppm of the alkali or alkaline earth metal. These low ash compositions make possible the adjustment of the frictional characteristics of the finished lubricant as may be required depending upon the type of base oil used. For example with base oils containing a high proportion of poly-alpha-olefin oligomer ("PAO") base oil, it is desirable to utilize a friction-increasing amount of one or more metal carboxylates, metal phenates, and/or metal sulfonates.

Use of the lubricants of this invention for extended drain service or as total driveline lubricants, or both, form additional embodiments of this invention.

Lubricants of the current invention may be used as (i) a gear box lubricant or (ii) an axle lubricant or as a lubricant for (i) and (ii). Lubricants suitable for these uses have a viscosity of from SAE 75W90 to 85W90 and preferably 80W90.

Another embodiment is a method of inhibiting pitting and enhancing tooth life of gears in a gear box and/or axle of a vehicle which comprises introducing into the gear box and/or axle a lubricant in accordance with this invention and keeping that lubricant therein as the gear lubricant therefor for the period of service recommended or specified by the manufacturer of the vehicle.

A further embodiment of this invention comprises a method of inhibiting pitting and enhancing tooth life of gears in a gear box or axle(s) of a vehicle designed for heavy duty service which comprises introducing into the gear box or axle(s) as the gear lubricant therefor, a lubricant composition of this invention and maintaining that lubricant in the gear box and/or axle(s) for a total of at least 100,000 miles of vehicle operation.

Still another embodiment is a gear box and/or axle(s) for a motor vehicle designed for heavy duty service containing as the lubricant for the gears therein, a lubricant in accordance with this invention.

The above and other embodiments, features and advantages of this invention will become still further apparent from the ensuing description and appended claims.

Component a)

An essential feature of this invention is that the oil-soluble sulfur-containing antiwear and/or extreme pressure agent(s) used be of low activity as determined by the copper corrosion test described below. Subject to this proviso, categories of materials in which suitable materials may exist include sulfurized olefins, sulfurized unsaturated fatty acids and/or esters, dihydrocarbyl polysulfides, trithiones, sulfurized thienyl derivatives, sulfurized terpenes, sulfurized oligomers of $C_2$-$C_8$ monoolefins, sulfurized Diels-Alder adducts, and in general compounds which contain sulfur bound directly to carbon or to more sulfur. Specific examples of such materials include sulfurized polyisobutene of Mn 1,100, sulfurized isobutylene, sulfurized diisobutylene, sulfurized triisobutylene, dicyclohexyl polysulfide, diphenyl polysulfide, dibenzyl polysulfide, dinonyl polysulfide, and mixtures of di-tert-butyl polysulfide such as mixtures of di-tert-butyl trisulfide, di-tert-butyl tetrasulfide and di-tert-butyl pentasulfide, among others. Combinations of such categories of sulfur-containing antiwear and/or extreme pressure agents can also be used, such as a combination of sulfurized isobutylene and di-tert-butyl trisulfide, a combination of sulfurized isobutylene and dinonyl trisulfide, a combination of sulfurized tall oil and dibenzyl polysulfide, and the like.

To determine whether a sulfur-containing material is of low activity, use is made of a copper coupon corrosion test conducted as follows: A copper coupon approximately 70×15 mm and about 1.25 mm in thickness is cleaned by use of steel wool (0000 grade), washed with heptane, and then with acetone, dried, and weighed to the nearest 0.1 mg. The cleaned coupon is placed in a test tube and covered completely with the composition to be tested, and the system is heated to 125° C. by means of an oil bath. After holding the system at 125° C. for three hours, the copper coupon is removed from the test tube, rinsed with heptane, and then with acetone. The dried coupon is then rubbed with a paper towel moistened with acetone to remove any surface flakes formed by copper corrosion. The coupon is then air-dried and weighed to the nearest 0.1 mg. The difference in weight between the initial copper coupon and the coupon after the test represents the extent to which the copper was corroded under the test conditions. Therefore the larger the weight difference, the greater the copper corrosion, and thus the more active the sulfur compound. For the purposes of this invention, if the coupon weight loss is above 65 milligrams, the sulfur-containing agent is considered "active". Thus pursuant to this invention the sulfur component or components used should give a copper weight loss in this test of not more than 65 milligrams, preferably 50 mg or less, more preferably 35 mg or less, still more preferably 25 mg or less, and most preferably less than 20 milligrams. In short, the lower the value (as long as there is some activity), We more preferred the material for use in the practice of this invention.

Examples of commercially available materials of low activity include HiTEC® 312 additive and HiTEC® 313 additive (sulfurized isobutylene products of Ethyl Petroleum Additives Limited and Ethyl Petroleum Additives, Inc.), and Anglamol 33 additive (a sulfurized isobutylene product of The Lubrizol Corporation).

Because of the toxicity of hydrogen sulfide, it is highly preferable, though not essential, to utilize in the practice of this invention oil-soluble sulfur-containing antiwear and/or extreme pressure agents, and more preferably oil-soluble active sulfur-containing antiwear and/or extreme pressure agents, that yield less than 25 ppm, and more preferably less than 10 ppm, of vapor space $H_2S$ when heated in the concentrated state for one week at 65° C. Most preferred are materials of this type which yield no detectable vapor space $H_2S$ when tested under these conditions.

From the cost-effectiveness standpoint, the most preferred oil-soluble metal-free sulfur-containing antiwear and/or extreme pressure agents are the low activity sulfurized olefins containing at least 30% by weight of sulfur, the low activity dihydrocarbyl polysulfides containing at least 25% by weight of sulfur, and mixtures of such sulfurized olefins and polysulfides. Of these materials, low activity sulfurized isobutylenes having a sulfur content of at least 35% by weight and a chlorine content, if any, of less than 0.2% by weight are the most especially preferred materials.

Methods of preparing sulfurized olefins are described in U.S. Pat. Nos. 2,995,569; 3,673,090; 3,703,504; 3,703,505; 3,796,661; and 3,873,454.

Component b)

For purposes of this invention a component which contains both phosphorus and sulfur in its chemical structure is deemed a phosphorus-containing antiwear and/or extreme pressure agent rather than a sulfur-containing antiwear and/or extreme pressure agent.

One suitable type of oil-soluble metal-free phosphorus- and nitrogen-containing antiwear and/or extreme pressure agent which can be employed in the practice of this invention is the phosphorus- and nitrogen-containing compositions of the type described in G.B. 1,009,913; G.B. 1,009,914; U.S. Pat. No. 3,197,405 and/or U.S. Pat. No. 3,197,496. In general, these compositions are formed by forming an acidic intermediate by the reaction of a hydroxy-substituted triester of a phosphorothioic acid with an inorganic phosphorus acid, phosphorus oxide or phosphorus halide, and neutralizing a substantial portion of said acidic intermediate with an amine or hydroxy-substituted amine.

Another type of phosphorus- and nitrogen-containing antiwear and/or extreme pressure additive which can be used in the compositions of this invention is the amine salts of hydroxy-substituted phosphetanes or the amine salts of hydroxy-substituted thiophosphetanes. Typically, such salts are derived from compounds of the formula

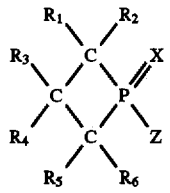

wherein each of $R_1$, $R_2$, $R_3$, $R_4$, $R_5$ and $R_6$ is a hydrogen atom or a carbon-bonded organic group such as a hydrocarbyl group or a substituted hydrocarbyl group wherein the substituent(s) do(es) not materially detract from the predominantly hydrocarbonaceous character of the hydrocarbyl group; X is a sulfur or an oxygen atom and Z is a hydroxyl group or an organic group having one or more acidic hydroxyl groups. Examples of this general type of antiwear and/or extreme pressure agent include the amine salts hydroxyphosphetanes and the amine salts of hydroxythiophosphetanes typified by Irgalube 295 additive (Ciba-Geigy Corporation).

Another useful category of phosphorus- and nitrogen-containing antiwear and/or extreme pressure agents is comprised of the amine salts of partial esters of phosphoric and thiophosphoric acids. Such compounds may be collectively represented by the formulas I, II, and III as follows:

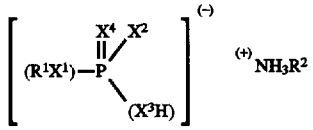

(I)

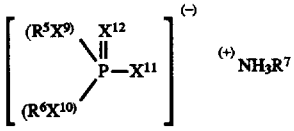

(III)

or mixtures thereof. In Formulas I, II and III, each of $R^1$, $R^2$, $R^3$, $R^4$, $R^5$, $R^6$, and $R^7$ is, independently, a hydrocarbyl group and each of $X^1$, $X^2$, $X^3$, $X^4$, $X^5$, $X^6$, $X^7$, $X^8$, $X^9$, $X^{10}$, $X^{11}$, and $X^{12}$ is, independently, an oxygen atom or a sulfur atom.

In one preferred sub-category the amine salts are formed with one or more partially esterified monothiophosphoric acids. These are compounds of Formulas (I), (II), and (III) above wherein only one of $X^1$, $X^2$, $X^3$, and $X^4$, only one of $X^5$, $X^6$, $X^7$, and $X^8$, and only one of $X^9$, $X^{10}$, $X^{11}$, and $X^{12}$ is a sulfur atom.

In another preferred sub-category the amine salts are formed with one or more partially esterified phosphoric acids. These are compounds of Formulas (I), (II), and (III) above wherein all of $X^1$, $X^2$, $X^3$, $X^4$, $X^5$, $X^6$, $X^7$, $X^8$, $X^9$, $X^{10}$, $X^{11}$, and $X^{12}$ are oxygen atoms.

Another preferred sub-category of amine salts are those formed with one or more partially esterified dithiophosphoric acids. These are compounds of Formulas (I), (II), and (III) above wherein two of $X^1$, $X^2$, $X^3$, and $X^4$, two of $X^5$, $X^6$, $X^7$, and $X^8$, and two of $X^9$, $X^{10}$, $X^{11}$, and $X^{12}$ are sulfur atoms.

Also useful are amine salts of Formulas (I), (II), and (III) above wherein three or four of $X^1$, $X^2$, $X^3$, and $X^4$, three or four of $X^5$, $X^6$, $X^7$, and $X^8$, and three or four of $X^9$, $X^{10}$, $X^{11}$, and $X^{12}$ are sulfur atoms.

While all of the above oil-soluble amine salts are useful as components in the compositions of this invention, it is most preferred to include at least one oil-soluble amine salt of a dihydrocarbyl monothiophosphoric acid (one sulfur atom per molecule), either alone or in combination with at least one oil-soluble amine salt of a dihydrocarbyl phosphoric acid (no sulfur atom in the molecule).

Suitable salts or adducts include octylamine, nonylamine, decylamine, undecylamine, dodecylamine, tridecylamine, tetradecylamine, pentadecylamine, hexadecylamine, heptadecylamine, octadecylamine, cyclohexylamine, phenylamine, mesitylamine, oleylamine, cocoamine, soyamine, $C_8$ tertiary alkyl primary amine, $C_{12-14}$ tertiary alkyl primary amine, $C_{22-24}$ tertiary alkyl primary amine, phenethylamine, etc., salts or adducts of partially esterified phosphoric, monothiophosphoric, dithiophosphoric, trithiophosphoric, and/or tetrathiophosphoric acids, including mixtures of any such compounds. Generally speaking, the preferred amine salts are salts of aliphatic amines, especially the saturated or olefinically unsaturated aliphatic primary amines, such as n-octylamine, 2-ethylhexylamine, tert-octylamine, n-decylamine, the $C_{10}$, $C_{12}$, $C_{14}$ and $C_{16}$ tertiary alkyl primary amines (either singly or in any combinations thereof, such as a mixture of the $C_{12}$ and $C_{14}$ tertiary alkyl primary amines), n-undecylamine, a mixture of $C_{14}$ to $C_{18}$ tertiary alkyl primary amines, lauryl amine, hexadecylamine, heptadecylamine, octadecylamine, the $C_{22}$ and $C_{24}$ tertiary alkyl primary amines (either singly or in combination), decenylamine, dodecenylamine, palmitoleylamine, oleylamine, linoleylamine, eicosenylamine, etc. Secondary hydrocarbyl amines and tertiary hydrocarbyl amines can also be used either alone or in combination with each other or in combination with primary amines. Thus any combination of primary, secondary and/or tertiary amines, whether monoamine or polyamine, can be used in forming the salts or adducts.

Similarly, the amines used can be in the form of polyalkylene polyamines; functionally-substituted polyamines such as a succinimide or succinamide of a polyalkylene polyamines such as a polyisobutenyl succinimide of diethylene triamine, a polyisobutenyl succinimide of triethylene tetramine, a polyisobutenyl succinimide of tetraethylene pentamine, a polyisobutenyl succinimide of pentaethylene hexamine (including succinimides made from commercially available polyethylene polyamine mixtures which contain linear, branched and cyclic species); and Mannich bases derived from polyalkylene polyamines of the types just described. Moreover, the polyalkylene polyamines whether in the free state or in the form of a succinimide, succinamide, or Mannich base, can be partially boronated, partially phosphorylated, or partially acylated with a reagent such as maleic anhydride, malic acid, itaconic acid, itaconic anhydride, thiomalic acid, fumaric acid, and the like, provided that such boronated or phosphorylated or acylated amine or amine moiety contains at least sufficient residual basicity to enable it to form a salt with the partially esterified phosphoric or thiophosphoric acid. Alkylene polyamines in the form of succinimides, succinamides or Mannich bases which have been boronated and phosphorylated are described for example in U.S. Pat. No. 4,857,214.

Use of primary amines is preferred. Especially preferred amines are alkyl monoamines and alkenyl monoamines having from about 8 to about 24 carbon atoms in the molecule.

Amines having less than 8 carbon atoms can be used, including methyl amine, etc., provided the resultant amine salt is oil-soluble. Likewise, amines having more than 24 carbon atoms can be used, again with the proviso that the resultant amine salt is oil soluble.

Methods for the preparation of such amine salts are well known and reported in the literature. See for example, U.S. Pat. Nos. 2,063,629; 2,224,695; 2,447,288; 2,616,905; 3,984,448; 4,431,552; Pesin et al, *Zhurnal Obshehei Khimii*, Vol. 31, No. 8, pp. 2508–2515 (1961); and International Application Publication No. WO 87/07638.

It should be noted that amine salts of partially esterified monothiophosphoric acids are usually made by reacting a mono- and/or dihydrocarbyl phosphite with sulfur or an active sulfur-containing compound such as are referred to above with reference to component a), and one or more primary or secondary amines. Such reactions tend to be highly exothermic reactions which can become uncontrollable, if not conducted properly. One preferred method of forming these amine salts involves a process which comprises (i) introducing, at a rate such that the temperature does not exceed about 60° C., one or more dihydrocarbyl hydrogen phosphites, such as a dialkyl hydrogen phosphite, into an excess quantity of one or more active sulfur-containing materials, such as sulfurized branched-chain olefin (e.g., isobutylene, diisobutylene, triisobutylene, etc.), while agitating the mixture so formed, (ii) introducing into this mixture, at a rate such that the temperature does not exceed about 60° C., one or more aliphatic primary or secondary amines, preferably one or more aliphatic primary monoamines having in the range of about 8 to about 24 carbon atoms per molecule while agitating the mixture so formed, and (iii) maintaining the temperature of the resultant agitated reaction mixture at between about 55° C. and about 60° C. until reaction is substantially complete. Another suitable way of producing these amine salts is to concurrently introduce all three of the reactants into the reaction zone at suitable rates and under temperature control such that the temperature does not exceed about 60° C. Another preferred way of forming amine salts of partially esterified monothiophosphoric acids is to pre-react elemental sulfur with the amine for a short period of time and then add thereto the appropriate dihydrocarbyl hydrogen phosphite at a rate such that the temperature does not become excessive and the reaction uncontrollable.

Preferably, component b) comprises (i) at least one amine salt of a dihydrocarbyl monothiophosphoric acid or (ii) at least one amine salt of a hydrocarbyl phosphoric acid, or both of (i) and (ii).

Component c)

The oil-soluble carboxylic acids used in the formation of the compositions of this invention can be monocarboxylic acids or polycarboxylic acids, and can be aliphatic, cycloaliphatic, aromatic or heterocyclic in character. The aliphatic carboxylic acids will generally contain a chain of at least 6 or 7 carbon atoms to insure good oil solubility. Similarly, the cyclic carboxylic acids will typically carry at least one aliphatic substituent on the ring having at least 6 or 7 carbon atoms, again to ensure that the acid has good oil solubility. Each aliphatic group of the acids, whether bonded to a cyclic moiety or constituting the aliphatic portion of an acyclic carboxylic acid, is preferably either saturated or contains at most up to 3 to 4 olefinic double bonds. In other words, the acids are preferably devoid of acetylenic unsaturation. The acid can be formulated into the composition as a free acid or as a partially or fully neutralized amine salt. When fully or partially neutralized by amine prior to being introduced into the composition, it is desirable to employ an amine similar to or the same as the amine being used as component d) of the composition of this invention. Component c) can either be a single compound or a mixture of two or more different carboxylic acids. In light of the foregoing description, those of ordinary skill in the art will have no difficulty in selecting suitable carboxylic acids for use pursuant to this invention.

Preferred acids for use in the practice of this invention comprise one or a mixture of aliphatic monocarboxylic acids having in the range of 8 to 24 carbon atoms per molecule, especially octanoic acid and fatty acids such as palmitic acid, stearic acid, oleic acid, ricinoleic acid, linoleic acid and linolenic acid.

Component d)

Oil-soluble amines that can be used in the formation of the compositions of this invention include monoamines and polyamines, and in either case the amine can be aliphatic, cycloaliphatic, aromatic and/or heterocyclic in character. The amines can be tertiary amines, secondary amines, primary mines, and, in the case of polyamines can be in part primary, and/or in part secondary and/or in part tertiary. The aliphatic amines will generally contain a chain of at least 6 carbon atoms to insure good oil solubility. Similarly, the cyclic mines will typically carry at least one aliphatic substituent on the ring having at least 6 or 7 carbon atoms, again to ensure that the amine has good oil solubility. Each aliphatic group of the amines, whether bonded to a cyclic moiety or constituting the aliphatic portion of an acyclic amine, is preferably either saturated or contains at most up to 3 to 4 olefinic double bonds. In other words, the amines are preferably devoid of acetylenic unsaturation. The amine can be formulated into the composition as a free amine or in part as a partially or fully neutralized amine carboxylate salt. When fully or partially neutralized by carboxylic acid prior to being introduced into the composition, it is desirable to employ an acid similar to or the same as the acid being used as component c) of the composition of this invention. Component d) can be a single amine or a mixture of two or more different amines. Generally speaking, secondary amines are preferred over tertiary amines, and primary amines are the most preferred type. On the basis of the foregoing description, those of ordinary skill in the art will have no difficulty in selecting suitable amines for use pursuant to this invention.

Aliphatic primary monoamines having in the range of 6 to 24 carbon atoms per molecule such as hexyl amine, octyl amine, decyl amine, dodecyl amine, oleyl amine, and eicosyl amine, are preferred. Also preferred are the tertiary aliphatic primary amines such as are available commercially from Rohm & Haas Company under the trade designations Primene® 81R and Primene® JM-T, respectively.

Additional components can be and preferably are used in the compositions of this invention. Examples of such additional components are given below.

Component e)

The compositions of this invention preferably contain at least one oil-soluble trihydrocarbyl dithiophosphate. This group of optional but preferred compounds is composed of O,O-dihydrocarbyl-S-hydrocarbyl thiothionophosphates (also known as O,O-dihydrocarbyl-S-hydrocarbyl phosphorothiothionates) which can be represented by the general formula:

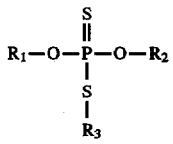

wherein each of $R_1$, $R_2$, and $R_3$ is independently a hydrocarbyl group, especially where $R_3$ is an alicyclic hydrocarbyl group. Particularly preferred are the O,O-dialkyl-S-hydrocarbyl phosphorothiothionates wherein $R_3$ is an alicyclic group an $R_1$ and $R_2$ are alkyl groups each having up to about 18 carbon atoms and most preferably up to about 12 carbon atoms.

These compounds can be made by various known methods. Probably the most efficacious method involves reacting phosphorus pentasulfide ($P_2S_5$, often regarded as $P_4S_{10}$) with the appropriate alcohols or mixture of alcohols. Compounds in which one of the hydrocarbyl groups differs from the other two are preferably made by first reacting the phosphorus pentasulfide with an appropriate alcohol to form an intermediate product, viz. $(RO)_2PSSH$, which in turn is reacted with a compound containing at least one reactive olefinic double bond. See in this connection U.S. Pat. Nos. 2,528,732, 2,561,773, 2,665,295, 2,767,206, 2,802,856, 3,023,209, and *J. Org. Chem.*, 1963, 28, 1262–8.

Exemplary compounds suitable for use in the compositions of this invention include such compounds as trioctylphosphorothiothionate, tridecylphosphorothiothionate, trilaurylphosphorothiothionate, O,O-diethyl bicyclo(2.2.1)-hepten-2-yl phosphorothiothionate, O,O-diethyl 7,7-dimethyl-bicyclo(2.2.1)-5-hepten-2-yl phosphorothiothionate, the product formed by reaction of dithiophosphoric acid-O,O-dimethyl ester with cis-endomethylene-tetrahydrophthalic acid dimethyl ester, the product formed by reaction of dithiophosphoric acid-O,O-dimethyl ester with cis-endomethylene-tetrahydrophthalic acid dibutyl ester, the product formed by reaction of dithiophosphoric acid-O,O-dibutyl ester with cis-endomethylene-tetrahydrophthalic acid dilauryl ester, the product formed by reaction of dithiophosphoric acid-O,O-dimethyl ester with 2,5-endomethylene-1-methyl-tetrahydrobenzoic acid butyl ester, the product formed by reaction of dithiophosphoric acid-O,O-dimethyl ester with 2,5-endomethylene-1-methyl-tetrahydrobenzoic acid decyl ester, the product formed by reaction of dithiophosphoric acid-O,O-dimethyl ester with 2,5-endomethylene-6-methyl-tetrahydrobenzoin acid ethyl ester, the product formed by reaction of dithiophosphoric acid-O,O-diethyl ester with 2,5-endomethylene-tetrahydrobenzyl alcohol, the product formed by reaction of dithiophosphoric acid-O,O-dimethyl ester with the Diels-Alder adduct of cyclopentadiene and allyl alcohol (2 mols:1 mol), the product formed by reaction of dithiophosphoric acid-O,O-dimethyl ester with 2,5-endomethylene-tetrahydrophenyl acetate, the product formed by reaction of dithiophosphoric acid-O,O-dibutyl ester with the Diels-Alder adduct of cyclopentadiene and vinyl acetate (2 mols:1 mol), the product formed by reaction of dithiophosphoric acid-O,O-dimethyl ester with the bis-cyclopentadiene adduct of p-benzoquinone, the product formed by reaction of dithiophosphoric acid-O,O-dimethyl ester with the azodicarboxylic acid diethyl ester, the product formed by reaction of dithiophosphoric acid-O,O-dimethyl ester with dicyclopentadiene, the product formed by reaction of dithiophosphoric acid-O,O-dibutyl ester with dicyclopentadiene, the product formed by reaction of dithiophosphoric acid-O,O-dioctyl ester with dicyclopentadiene, the product formed by reaction of dithiophosphoric acid-O,O-dilauryl ester with dicyclopentadiene, the product formed by reaction of dithiophosphoric acid-O,O-di-2-ethylhexyl ester with wax olefin, the product formed by reaction of dithiophosphoric acid-O,O-di-2-ethylhexyl ester with oleyl alcohol, the product formed by reaction of dithiophosphoric acid-O,O-di-2-ethylhexyl ester with linseed oil, the product formed by reaction of dithiophosphoric acid-O,O-diamyl ester with alpha pinene, the product formed by reaction of dithiophosphoric acid-O,O-diphenyl ester with alpha pinene, the product formed by reaction of dithiophosphoric acid-O,O-diamyl ester with allo-ocimene, the product formed by reaction of dithiophosphoric acid-O,O-dioctyl ester with dipentene, and the like.

Component f)

While not required, preferably at least one oil-soluble dispersant is included in the compositions of this invention. Any of a variety of materials known as ashless dispersants ("ashless" in the sense that they do not contain metallic constituents) can be utilized in the compositions of this invention. These include the following types:

1) Carboxylic Ashless Dispersants

These are reaction products of an acylating agent such as a monocarboxylic acid, dicarboxylic acid, polycarboxylic acid, or derivatives thereof which contain amine groups and/or hydroxyl groups (and optionally, other groups). These products, herein referred to as carboxylic ashless dispersants, are described in many patents, including British patent specification No. 1,306,529 and the following U.S. Pat. Nos.: 3,163,603; 3,184,474; 3,215,707; 3,219,666; 3,271,310; 3,272,746; 3,281,357; 3,306,908; 3,311,558; 3,316,177; 3,340,281; 3,341,542; 3,346,493; 3,381,022; 3,399,141; 3,415,750; 3,433,744; 3,444,170; 3,448,048; 3,448,049; 3,451,933; 3,454,607; 3,467,668; 3,522,179; 3,541,012; 3,542,678; 3,574,101; 3,576,743; 3,630,904; 3,632,510; 3,632,511; 3,697,428; 3,725,441; 3,868,330; 3,948,800; 4,234,435; and Re. 26,433.

There are a number of sub-categories of carboxylic ashless dispersants. One such sub-category which constitutes a preferred type is composed of the polyamine succinamides and more preferably the polyamine succinimides in which the succinic group contains a hydrocarbyl substituent containing at least 30 carbon atoms. The polyamine used in forming such compounds contains at least one primary amino group capable of forming an imide group on reaction with a hydrocarbon-substituted succinic acid or acid derivative thereof such an anhydride, lower alkyl ester, acid halide, or acid-ester. Representative examples of such dispersants are given in U.S. Pat. Nos. 3,172,892; 3,202,678; 3,216,936; 3,219,666; 3,254,025; 3,272,746; and 4,234,435. The alkenyl succinimides may be formed by conventional methods such as by heating an alkenyl succinic anhydride, acid, acid-ester, acid halide, or lower alkyl ester with a polyamine containing at least one primary amino group. The alkenyl succinic anhydride may be made readily by heating a mixture of olefin and maleic anhydride to about 180°–220° C. The olefin is preferably a polymer or copolymer of a lower monoolefin such as ethylene, propylene, 1-butene, isobutene and the like. The more preferred source of alkenyl group is from polyisobutene having a number average molecular weight of up to 100,000 or higher. In a still more preferred embodiment the alkenyl group is a polyisobutenyl group having a number average molecular weight of about 500–5,000, and preferably about 700–2,500, more preferably about 700–1,400, and especially 800–1,200. The isobutene used in making the polyisobutene is usually (but not necessarily) a mixture of isobutene and other $C_4$ isomers such as 1-butene. Thus, strictly speaking, the acylating agent formed from maleic anhydride and "polyisobutene" made from such mixtures of isobutene and other $C_4$ isomers such as 1-butene, can be termed a "polybutenyl succinic anhydride" and a succinimide made therewith can be termed a "polybutenyl succimide". However, it is common to refer to such substances as "polyisobutenyl succinic anhydride" and "polyisobutenyl succinimide", respectively. As used herein "polyisobutenyl" is used to denote the alkenyl moiety whether made from a highly pure isobutene or a more impure mixture of isobutene and other $C_4$ isomers such as 1-butene.

Polyamines which may be employed in forming the ashless dispersant include any that have at least one primary amino group which can react to form an imide group. A few representative examples include branched-chain alkanes containing two or more primary amino groups such as tetraamino-neopentane, etc.; polyaminoalkanols such as 2-(2-aminoethylamino)-ethanol and 2-[2-(2-aminoethylamino)-ethylamino]-ethanol; heterocyclic compounds containing two or more amino groups at least one of which is a primary amino group such as 1-(β-aminoethyl)-2-imidazolidone, 2-(2-aminoethylamino)-5-nitropyridine, 3-amino-N-ethylpiperidine, 2-(2-aminoethyl)-pyridine, 5-aminoindole, 3-amino-5-mercapto-1,2,4-triazole, and 4-(aminomethyl)-piperidine; and the alkylene polyamines such as propylene aliamine, dipropylene triamine, di-(1,2-butylene)triamine, N-(2-aminoethyl)-1,3-propanediamine, hexamethylenediamine and tetra-(1,2-propylene)pentamine.

The most preferred amines are the ethylene polyamines which can be relatively pure individual compounds or, more typically, commercially-available mixtures of linear, branched and cyclic species. The ethylene polyamines include ethylene aliamine, diethylene triamine, triethylene tetramine, tetraethylene pentamine, pentaethylene hexamine, and the like, including mixtures thereof. The cyclic species present in various commercial mixtures include N-aminoethyl piperazine, N,N'-bis(aminoethyl) piperazine, N,N'-bis(piperazinyl)ethane, and like compounds. Many of the ethylene polyamines have a primary amine group at each end so can form monoalkenylsuccinimides and bis-alkenylsuccinimides. The preferred commercial mixtures have approximate overall compositions falling in the range corresponding to diethylene triamine to penmethylene hexamine, mixtures generally corresponding in overall makeup to tetraethylene pentamine being most preferred. Methods for the production of polyalkylene polyamines are known and reported in the literature. See for example U.S. Pat. No. 4,827,037 and references cited therein.

Preferred ashless dispersants are the products of reaction of a polyethylene polyamine, e.g. triethylene tetramine or tetraethylene pentamine, with a hydrocarbon-substituted carboxylic acid or anhydride (or other suitable acid derivative) made by reaction of a polyolefin, preferably polyisobutene, having a number average molecular weight of 500 to 5,000, preferably 700 to 2,500, more preferably 700 to 1,400 and especially 800 to 1,200, with an unsaturated polycarboxylic acid or anhydride, e.g., maleic anhydride, maleic acid, fumaric acid, or the like, including mixtures of two or more such substances.

As used herein the term "succinimide" is meant to encompass the completed reaction product from reaction between the amine reactant(s) and the hydrocarbon-substituted carboxylic acid or anhydride (or like acid derivative) reactant (s), and is intended to encompass compounds wherein the product may have amide, amidine, and/or salt linkages in addition to the imide linkage of the type that results from the reaction of a primary amino group and an anhydride moiety.

Residual unsaturation in the alkenyl group of the alkenyl succinimide may be used as a reaction site, if desired. For example the alkenyl substituent may be hydrogenated to form an alkyl substituent. Similarly the olefinic bond(s) in the alkenyl substituent may be sulfurized, halogenated, hydrohalogenated or the like. Ordinarily, there is little to be gained by use of such techniques, and thus the use of alkenyl succinimides is preferred.

Another sub-category of carboxylic ashless dispersants which can be used includes alkenyl succinic acid esters and diesters of alcohols containing 1–20 carbon atoms and 1–6 hydroxyl groups. Representative examples are described in U.S. Pat. Nos. 3,331,776; 3,381,022; and 3,522,179. The alkenyl succinic portion of these esters corresponds to the alkenyl succinic portion of the succinimides described above including the same preferred and most preferred subgenus, e.g., alkenyl succinic acid, and anhydrides, etc., where the alkenyl group contains at least 30 carbon atoms and notably, polyisobutenyl succinic acids and anhydrides wherein the polyisobutenyl group has a number average molecular weight of 500 to 5,000, preferably 700 to 2,500, more preferably 700 to 1,400, and especially 800 to 1,200. As in the case of the succinimides, the alkenyl group can be hydrogenated or subjected to other reactions involving olefinic double bonds.

Alcohols useful in preparing the esters include methanol, ethanol, 2-methylpropanol, octadecanol, eicosanol, ethylene glycol, diethylene glycol, tetraethylene glycol, diethylene glycol monoethylether, propylene glycol, tripropylene glycol, glycerol, sorbitol, 1,1,1-trimethylol ethane, 1,1,1-trimethylol propane, 1,1,1-trimethylol butane, pentaerythritol, dipentaerythritol, and the like.

The succinic esters are readily made by merely heating a mixture of alkenyl succinic acid, anhydrides or lower alkyl (e.g., $C_1$-$C_4$) ester with the alcohol while distilling out water or lower alkanol. In the case of acid-esters less alcohol is used. In fact, acid-esters made from alkenyl succinic anhydrides do not evolve water. In another method the alkenyl succinic acid or anhydrides can be merely reacted with an appropriate alkylene oxide such as ethylene oxide, propylene oxide, and the like, including mixtures thereof.

Still another sub-category of useful carboxylic ashless dispersants comprises an alkenyl succinic ester-amide mixture. These may be made by heating the above-described alkenyl succinic acids, anhydrides or lower alkyl esters or etc. with an alcohol and an amine either sequentially or in a mixture. The alcohols and amines described above are also useful in this embodiment. Alternatively, amino alcohols can be used alone or with the alcohol and/or amine to form the ester-amide mixtures. The amino alcohol can contain 1–20 carbon atoms, 1–6 hydroxy groups and 1–4 amine nitrogen atoms. Examples are ethanolamine, diethanolamine, N-ethanol- diethylene triamine, and trimethylol aminomethane.

Here again, the alkenyl group of the succinic ester-amide can be hydrogenated or subjected to other reactions involving olefinic double bonds.

Representative examples of suitable ester-amide mixtures are described in U.S. Pat. Nos. 3,184,474; 3,576,743; 3,632,511; 3,804,763; 3,836,471; 3,862,981; 3,936,480; 3,948,800; 3,950,341; 3,957,854; 3,957,855; 3,991,098; 4,071,548; and 4,173,540.

Yet another sub-category of useful carboxylic ashless dispersants comprises the Mannich-based derivatives of hydroxyaryl succinimides. Such compounds can be made by reacting a polyalkenyl succinic anhydride with an aminophenol to produce an N-(hydroxyaryl) hydrocarbyl succinimide which is then reacted with an alkylene diamine or polyalkylene polyamine and an aldehyde (e.g., formaldehyde), in a Mannich-base reaction. Details of such synthesis are set forth in U.S. Pat. No. 4,354,950. As in the case of the other carboxylic ashless dispersants discussed above, the alkenyl succinic anhydride or like acylating agent is derived from a polyolefin, preferably a polyisobutene, having a number average molecular weight of 500 to 5,000, preferably 700 to 2,500, more preferably 700 to 1,400, and especially 800 to 1,200. Likewise, residual unsaturation in the polyalkenyl substituent group can be used as a reaction site as for example, by hydrogenation, sulfurization, or the like.

2) Hydrocarbyl Polyamine Dispersants

The hydrocarbyl polyamine dispersants are generally produced by reacting an aliphatic or alicyclic halide (or mixture thereof) containing an average of at least about 40 carbon atoms with one or more amines, preferably polyalkylene polyamines. Examples of such hydrocarbyl polyamine dispersants are described in U.S. Pat. Nos. 3,275,554; 3,438,757; 3,454,555; 3,565,804; 3,671,511; 3,821,302; and 3,394,576.

In general, the hydrocarbyl-substituted polyamines are high molecular weight hydrocarbyl-N-substituted polyamines containing basic nitrogen in the molecule. The hydrocarbyl group typically has a number average molecular weight in the range of about 750–10,000, more usually in the range of about 1,000–5,000.

The hydrocarbyl radical may be aliphatic or alicyclic and, except for adventitious amounts of aromatic components in petroleum mineral oils, will be free of aromatic unsaturation. The hydrocarbyl groups will normally be branched-chain aliphatic, having 0–2 sites of unsaturation, and preferably from 0–1 site of ethylene unsaturation. The hydrocarbyl groups are preferably derived from petroleum mineral oil, or polyolefins, either homopolymers or higher-order polymers, or 1-olefins of from 2–6 carbon atoms. Ethylene is preferably copolymerized with a higher olefin to insure oil solubility.

Illustrative polymers include polypropylene, polyisobutylene, poly-1-butene, etc. The polyolefin group will normally have at least one branch per six carbon atoms along the chain, preferably at least one branch per four carbon atoms along the chain. These branched-chain hydrocarbons are readily prepared by the polymerization of olefins of from 3–6 carbon atoms and preferably from olefins of from 3–4 carbon atoms.

In preparing the hydrocarbyl polyamine dispersants, rarely will a single compound having a defined structure be employed. With both polymers and petroleum-derived hydrocarbon groups, the composition is a mixture of materials having various structures and molecular weights. Therefore, in referring to molecular weight, number average molecular weights are intended. Furthermore, when speaking of a particular hydrocarbon group, it is intended that the group include the mixture that is normally contained within materials which are commercially available. For example, polyisobutylene is known to have a range of molecular weights and may include small amounts of very high molecular weight materials.

Particularly preferred hydrocarbyl-substituted amines or polyamines are prepared from polyisobutenyl chloride.

The polyamine employed to prepare the hydrocarbyl-substituted polyamine is preferably a polyamine having from 2 to about 12 amine nitrogen atoms and from 2 to about 40 carbon atoms. The polyamine is reacted with a hydrocarbyl halide (e.g., chloride) to produce the hydrocarbyl-substituted polyamine. The polyamine preferably has a carbon-to-nitrogen ratio of from about 1:1 to about 10:1.

The amino groups of the hydrocarbyl-substituted amine are typically substituted with hydrogen atoms or hydrocarbyl groups of from about 1 to about 10 carbon atoms. At least one of the nitrogens in the hydrocarbyl-substituted amine or polyamine is a basic nitrogen atom, i.e., one titratable by a strong acid.

Typical amines useful in preparing the hydrocarbyl-substituted amines include methylamine, dimethylamine, ethylamine, diethylamine, n-propylamine, di-n-propylamine, etc. Such amines are either commercially available or are prepared by art recognized procedures.

The polyamine component may also contain heterocyclic polyamines, heterocyclic substituted amines and substituted heterocyclic compounds, wherein the heterocyclic comprises one or more 5–6 membered rings containing oxygen and/or nitrogen. Such heterocyclics may be saturated or unsaturated and substituted with hydrocarbyl or aminohydrocarbyl groups. The heterocyclics are exemplified by piperazines, such as 2-methylpiperazine, 1,2-bis(N-piperazinyl-ethane), and N,N'-bis(N-piperazinyl)piperazine, 2-methylimidazoline, 3-aminopiperidine, 2-aminopyridine, 2-(β-aminoethyl)-3-pyrroline, 3-aminopyrrolidine, N-(3-aminopropyl)morpholine, etc. Among the heterocyclic compounds, the piperazines are usually preferred.

Typical polyamines that can be used to form the hydrocarbyl polyamine dispersants include the following: ethylene diamine, 1,2-propylene diamine, 1,3-propylene diamine, diethylene triamine, triethylene tetramine, hexamethylene diamine, tetraethylene pentamine, methylaminopropylene aliamine, N-(β-aminoethyl)piperazine, N,N'-di(β-aminoethyl)piperazine, N,N'-di(β-aminoethyl) imidazolidone-2, N-(β-cyanoethyl)ethane-1,2-diamine, 1,3,6,9-tetraaminooctadecane, 1,3,6-triamino-9-oxadecane, N-methyl-1,2-propanediamine, 2-(2-aminoethylamino) ethanol, and the like.

Another group of suitable polyamines are the polyalkylene amines in which the alkylene groups differ in carbon content, such as for example bis(aminopropyl) ethylenediamine. Such compounds are prepared by the reaction of acrylonitrile with an ethyleneamine, for example, an ethyleneamine of the formula $H_2H(CH_2CH_2NH)_nH$ wherein n is an integer from 1 to 5, followed by hydrogenation of the resultant intermediate. Thus, the product prepared from ethylene diamine and acrylonitrile followed by reduction of the nitrile group has the formula $H_2N(CH_2)_3NH(CH_2)_2NH(CH_2)_3NH_2$.

In many instances the polyamine used as a reactant in the production of the hydrocarbyl-substituted polyamine is not a single compound but a mixture in which one or several compounds predominate with the average composition indicated. For example, tetraethylene pentamine prepared by the polymerization of aziridine or the reaction of 1,2-dichloroethane and ammonia will have both lower and higher amine members, e.g., triethylene tetramine, substituted piperazines and pentaethylene hexamine, but the composition will be largely tetraethylene pentamine and the empirical formula of the total amine composition will closely approximate that of tetraethylene pentamine. Finally, in preparing the hydrocarbyl-substituted polyamines for use in this invention, where the various nitrogen atoms of the polyamine are not geometrically equivalent, several substitutional isomers are possible and are encompassed with the final product. Methods of preparation of polyamines and their reactions are detailed in Sidgewick, *The Organic Chemistry of Nitrogen*, Clarendon Press, Oxford, 1966; Noller, *Chemistry of Organic Compounds*, Saunders Philadelphia, 2nd Ed., 1957; and Kirk-Othmer, *Encyclopedia of Chemical Technology*, 2nd Edition, especially volume 2, pp. 99–116.

The preferred hydrocarbyl-substituted polyalkylene polyamines may be represented by the formula $$R_1NH—(—R_2—NH—)_\alpha—H$$

wherein $R_1$ is hydrocarbyl having an average molecular weight of from about 750 to about 10,000; $R_2$ is alkylene of from 2 to 6 carbon atoms; and α is an integer of from 0 to about 10.

Preferably, $R_1$ is hydrocarbyl having an average molecular weight of from about 1,000 to about 10,000. Preferably, $R_2$ is alkylene of from 2 to 3 carbon atoms and α is preferably an integer of from 1 to 6.

3) Mannich polyamine dispersants

This category of ashless dispersant is comprised of reaction products of an alkyl phenol, with one or more aliphatic aldehydes containing from 1 to about 7 carbon atoms (especially formaldehyde and derivatives thereof), and polyamines (especially polyalkylene polyamines of the type described hereinabove). Examples of these Marreich polyamine dispersants are described in the following U.S. Pat. Nos.: 2,459,112; 2,962,442; 2,984,550; 3,036,003; 3,166,516; 3,236,770; 3,368,972; 3,413,347; 3,442,808; 3,448,047; 3,454,497; 3,459,661; 3,493,520; 3,539,633; 3,558,743; 3,586,629; 3,591,598; 3,600,372; 3,634,515; 3,649,229; 3,697,574; 3,703,536; 3,704,308; 3,725,277; 3,725,480; 3,726,882; 3,736,357; 3,751,365; 3,756,953; 3,793,202; 3,798,165; 3,798,247; 3,803,039; 3,872,019; 3,980,569; and 4,011,380.

The polyamine group of the Mannich polyamine dispersants is derived from polyamine compounds characterized by containing a group of the structure —NH— wherein the two remaining valances of the nitrogen are satisfied by hydrogen, amino, or organic radicals bonded to said nitrogen atom. These compounds include aliphatic, aromatic, heterocyclic and carbocyclic polyamines. The source of the oil-soluble hydrocarbyl group in the Mannich polyamine dispersant is a hydrocarbyl-substituted hydroxy aromatic compound comprising the reaction product of a hydroxy aromatic compound, according to well known procedures, with a hydrocarbyl donating agent or hydrocarbon source. The hydrocarbyl substituent provides substantial oil solubility to the hydroxy aromatic compound and, preferably, is substantially aliphatic in character. Commonly, the hydrocarbyl substituent is derived from a polyolefin having at least about 40 carbon atoms. The hydrocarbon source should be substantially free from pendant groups which render the hydrocarbyl group oil insoluble. Examples of acceptable substituent groups are halide, hydroxy, ether, carboxy, ester, amide, nitro and cyano. However, these substituent groups preferably comprise no more than about 10 weight percent of the hydrocarbon source.

The preferred hydrocarbon sources for preparation of the Mannich polyamine dispersants are those derived from substantially saturated petroleum fractions and olefin polymers, preferably polymers of mono-olefins having from 2 to about 30 carbon atoms. The hydrocarbon course can be derived, for example, from polymers of olefins such as ethylene, propene, 1-butene, isobutene, 1-octene, 1-methylcyclohexene, 2-butene and 3-pentene. Also useful are copolymers of such olefins with other polymerizable olefinic substances such as styrene. In general, these copolymers should contain at least 80 percent and preferably about 95 percent, on a weight basis, of units derived from the aliphatic mono-olefins to preserve oil solubility. The hydrocarbon source generally contains at least about 40 and preferably at least about 50 carbon atoms to provide substantial oil solubility to the dispersant. The olefin polymers having a number average molecular weight between about 600 and 5,000 are preferred for reasons of easy reactivity and low cost. However, polymers of higher molecular weight can also be used. Especially suitable hydrocarbon sources are isobutylene polymers.

The Mannich polyamine dispersants are generally prepared by reacting a hydrocarbyl-substituted hydroxy aromatic compound with an aldehyde and a polyamine.

Typically, the substituted hydroxy aromatic compound is contacted with from about 0.1 to about 10 moles of polyamine and about 0.1 to about 10 moles of aldehyde per mole of substituted hydroxy aromatic compound. The reactants are mixed and heated to a temperature above about 80° C. to initiate the reaction. Preferably, the reaction is carried out at a temperature from about 100° to about 250° C. The resulting Mannich product has a predominantly benzylamine linkage between the aromatic compound and the polyamine. The reaction can be carried out in an inert diluent such as mineral oil, benzene, toluene, naphtha, ligroin, or other inert solvents to facilitate control of viscosity, temperature and reaction rate.

Polyamines are preferred for use in preparing the Mannich polyamine dispersants, and suitable polyamines include, but are not limited to, alkylene diamines and polyalkylene polyamines (and mixtures thereof) such as polyamines referred to above. Suitable polyamines for use in preparation of the Mannich polyamine dispersants include methylene polyamines, ethylene polyamines, butylene polyamines, propylene polyamines, pentylene polyamines, hexylene polyamines and heptylene polyamines. The higher homologs of such amines and related aminoalkyl-substituted piperazines are also suitable. Specific examples of such polyamines include ethylene aliamine, triethylene tetramine, tris(2-aminoethyl)amine, propylene aliamine, pentamethylene aliamine, hexamethylene aliamine, heptamethylene aliamine, octamethylene aliamine, decamethylene diamine, di(heptamethylene) triamine, pentaethylene hexamine, di(trimethylene) triamine, 2-heptyl-3-(2-aminopropyl) imidazoline, 1,3-bis(2-aminoethyl)imidazoline, 1-(2-aminopropyl)piperazine, 1,4-bis(2-aminoethyl)piperazine and 2-methyl-1-(2-aminobutyl)piperazine. Higher homologs, obtained by condensing two or more of the above mentioned amines, are also useful, as are the polyoxyalkylene polyamines.

The polyalkylene polyamines, examples of which are set forth above, are especially useful in preparing the Marreich polyamine dispersants for reasons of cost and effectiveness. Such polyamines are described in detail under the heading "Diamines and Higher Amines" in Kirk-Othmer, *Encyclopedia of Chemical Technology*, Second Edition, Vol. 7, pp. 22–39. They are prepared most conveniently by the reaction of an ethylene imine with a ring-opening reagent such as ammonia. These reactions result in the production of somewhat complex mixtures of polyalkylene polyamines which include cyclic condensation products such as piperazines. Because of their availability, these mixtures are particularly useful in preparing the Mannich polyamine dispersants. However, satisfactory dispersants can also be obtained by use of pure polyalkylene polyamines.

Alkylene diamines and polyalkylene polyamines having one or more hydroxyalkyl substituents on the nitrogen atom are also useful in preparing the Mannich polyamine dispersants. These materials are typically obtained by reaction of the corresponding polyamine with an epoxide such as ethylene oxide or propylene oxide. Preferred hydroxyalkyl-substituted diamines and polyamines are those in which the hydroxyalkyl groups have less than about 10 carbon atoms. Examples of suitable hydroxyalkyl-substituted diamines and polyamines include, but are not limited to, N-(2-hydroxyethyl)ethylenediamine, N,N'-bis(2-hydroxyethyl) ethylenediamine, mono(hydroxypropyl)diethylenetriamine, (di(hydroxypropyl)tetraethylenepentamine and N-(3-hydroxybutyl)tetramethylenediamine. Higher homologs obtained by condensation of the above mentioned hydroxyalkyl-substituted diamines and polyamines through amine groups or through ether groups are also useful.

Any conventional formaldehyde yielding reagent is useful for the preparation of the Mannich polyamine dispersants. Examples of such formaldehyde yielding reagents are trioxane, paraformaldehyde, trioxymethylene, aqueous formalin and gaseous formaldehyde.

4) Polymeric polyamine dispersants

Also suitable are polymers containing basic amine groups and oil solubilizing groups (for example, pendant alkyl groups having at least about 8 carbon atoms). Such materials include, but are not limited to, interpolymers of decyl methacrylate, vinyl decyl ether or a relatively high molecular weight olefin with aminoalkyl acrylates and aminoalkyl acrylamides. Examples of polymeric polyamine dispersants are set forth in the following patents: U.S. Pat. Nos. 3,316,177; 3,326,804; 3,329,658; 3,449,250; 3,493,520; 3,519,565; 3,666,730; 3,687,849; 3,702,300; 4,089,794; 4,632,769.

5) Post-treated basic nitrogen-containing and/or hydroxyl-containing ashless dispersants As is well known in the art, any of the ashless dispersants referred to above as types 1)–4) can be subjected to post-treatment with one or more suitable reagents such as acids of boron, boron oxides, boron esters, ammonium borate, urea, thiourea, carbon disulfide, aldehydes, ketones, carboxylic acids, anhydrides of low molecular weight dibasic acids, nitriles, epoxides, and the like. Such post-treated ashless dispersants can be used in the compositions of this invention. Examples of post-treatment procedures and post-treated ashless dispersants are set forth in the following patents: U.S. Pat. Nos. 3,036,003; 3,200,107; 3,216,936; 3,256,185; 3,278,550; 3,312,619; 3,366,569; 3,367,943; 3,373,111; 3,403,102; 3,442,808; 3,455,831; 3,455,832; 3,493,520; 3,502,677; 3,513,093; 3,573,010; 3,579,450; 3,591,598; 3,600,372; 3,639,242; 3,649,229; 3,649,659; 3,702,757; and 3,708,522; and 4,971,598.

Mannich-based derivatives of hydroxyaryl succinimides that have been post-treated with $C_5$-$C_9$ lactones such as ε-caprolactone and optionally with other post-treating agents as described for example in U.S. Pat. No. 4,971,711 can also be utilized. See also U.S. Pat. Nos. 4,820,432; 4,828,742; 4,866,135; 4,866,139; 4,866,140; 4,866,141; 4,866,142; 4,906,394; and 4,913,830.

One preferred category of post-treated ashless dispersants is comprised of basic nitrogen-containing and/or hydroxyl group-containing ashless dispersants which have been heated with a phosphorus compound such that they contain phosphorus with the proviso that such post-treated products contain residual basic nitrogen and/or one or more residual hydroxyl groups. Numerous examples of such dispersants and methods for their production are described in U.S. Pat. Nos. 3,184,411; 3,185,645; 3,235,497; 3,265,618; 3,324,032; 3,325,567; 3,403,102; 3,502,677; 3,513,093; 3,511,780; 3,623,985; 3,865,740; 3,950,341; 3,991,056; 4,097,389; 4,234,435; 4,338,205; 4,428,849; 4,615,826; 4,648,980; 4,747,971; and 4,873,004.

Boronated Mannich base dispersants are the most preferred dispersants for use in the compositions of this invention.

Component g)

Preferred compositions of this invention contain at least one oil-soluble foam inhibitor. Suitable foam inhibitors include silicones, organic polymers such as acrylate polymers, and in general substances such as are described in *Foam Control Agents* by H. T. Kerner (Noyes Data Corporation, 1976, pages 125–176). Mixtures of silicone-type antifoam agents such as the liquid dialkyl silicone polymers with various other substances are also effective.

Typical of such mixtures are silicones mixed with an acrylate polymer, silicones mixed with one or more amines, and silicones mixed with one or more amine carboxylates.

Component h)

Oil-soluble oxidation inhibitors constitute another category of preferred components for use in the compositions of this invention. These materials are exemplified by the phenolic antioxidants, aromatic amine antioxidants, sulfurized phenolic antioxidants, and organic phosphites, among others. Examples of phenolic antioxidants include 2,6-di-tert-butylphenol, liquid mixtures of tertiary butylated phenols, 2,6-di-tert-butyl-4-methylphenol, 4,4'-methylenebis(2,6-di-tert-butylphenol), 2,2'-methylenebis(4-methyl-6-tert-butylphenol), mixed methylene-bridged polyalkyl phenols, and 4,4'-thiobis(2-methyl-6-tert-butylphenol). N,N'-Di-see-butyl-p-phenylenediamine, 4-isopropylaminodiphenyl amine, phenyl-α-naphthyl mine, phenyl-β-naphthyl amine, and ring-alkylated diphenylamines serve as examples of aromatic amine antioxidants.

Component i)

Desirably and preferably, at least one oil-soluble corrosion inhibitor is included in the compositions of this invention. One type of rust or corrosion inhibitor which may be used comprises monocarboxylic acids and polycarboxylic acids. Examples of suitable monocarboxylic acids are octanoic acid, decanoic acid and dodecanoic acid. Suitable polycarboxylic acids include dimer and trimer acids such as are produced from such acids as tall oil fatty acids, oleic acid, linoleic acid, or the like. Products of this type are currently available from various commercial sources. Another useful type of rust inhibitor for use in the practice of this invention is comprised of the alkenyl succinic acid and alkenyl succinic anhydride corrosion inhibitors such as, for example, tetrapropenylsuccinic acid, tetrapropenylsuccinic anhydride, tetradecenylsuccinic acid, tetradecenylsuccinic anhydride, hexadecenylsuccinic acid, hexadecenylsuccinic anhydride, and the like. Also useful are the half esters of alkenyl succinic acids having 8 to 24 carbon atoms in the alkenyl group with alcohols such as the polyglycols. Other suitable rust or corrosion inhibitors include ether amines; acid phosphates; amines; polyethoxylated compounds such as ethoxylated amines, ethoxylated phenols, and ethoxylated alcohols; imidazolines; and aminosuccinic acids or derivatives thereof. Mixtures of such rust or corrosion inhibitors can be used.

Still other types of additive components may be included provided they do not upset the balance of performance properties made possible by the practice of this invention. Such materials include, for example, copper corrosion inhibitors, anti-squawk additives, viscosity modifiers, pour point depressants, seal swell agents, and dyes.

Particularly preferred compositions are those which contain in addition to components a) through d), at least one each of components e), f), g), h), and i).

Base Oil

The lubricant compositions of this invention may be formed from natural (e.g., mineral or vegetable oils) or synthetic base oils, or blends thereof.

Suitable mineral oils include those of appropriate viscosity refined from crude oil of any source including Gulf Coast, Midcontinent, Pennsylvania, California, Alaska, Middle East, North Sea. etc. Standard refinery operations may be used in processing the mineral oil. Among the general types of petroleum oils useful in the compositions of this invention are solvent neutrals, bright stocks, cylinder stocks, residual oils, hydrocracked base stocks, paraffin oils including pale oils, and solvent extracted naphthenie oils. Such oils and blends of them are produced by a number of conventional techniques which are widely known by those skilled in the art.

Among the suitable synthetic oils are homo- and interpolymers of $C_2$-$C_{12}$ olefins, carboxylic acid esters of both monoalcohols and polyols, polyethers, silicones, polyglycols, silicates, alkylated aromatics, carbonates, thiocarbonates, orthoformates, phosphates and phosphites, borates and halogenated hydrocarbons. Representative of such oils are homo- and interpolymers of $C_2$-$C_{12}$ monoolefinic hydrocarbons, alkylated benzenes (e.g., dodecyl benzenes, didodecyl benzenes, tetradecyl benzenes, dinonyl benzenes, di-(2-ethylhexyl)-benzenes, wax-alkylated naphthalenes); and polyphenyls (e.g., biphenyls, terphenyls).

Alkylene oxide polymers and interpolymers and derivatives thereof where the terminal hydroxyl groups have been modified by esterification, etherification, etc., constitute another class of synthetic oils. These are exemplified by the oils prepared through polymerization of alkylene oxides such as ethylene oxide or propylene oxide, and the alkyl and aryl ethers of these polyoxyalkylene polymers (e.g., methyl polyisopropylene glycol ether having an average molecular weight of 1,000, diphenyl ether of polyethylene glycol having a molecular weight of 500–1,000, diethyl ether of polypropylene glycol having a molecular weight of 1,000–1,500) or mono- and poly-carboxylic esters thereof, for example, the acetic acid ester, mixed $C_3$-$C_6$ fatty acid esters, or the $C_{13}$ Oxo acid diester of tetraethylene glycol.

Another suitable class of synthetic oils comprises the esters of dicarboxylic acids (e.g., phthalic acid, succinic acid, maleic acid, azelaic acid, suberic acid, sebacic acid, fumaric acid, adipic acid, linoleic acid dimer) with a variety of alcohols (e.g., butyl alcohol, hexyl alcohol, dodecyl alcohol, 2-ethylhexyl alcohol, ethylene glycol). Specific examples of these esters include dibutyl adipate, di(2-ethylhexyl) adipate, didodecyl adipate, di(tridecyl) adipate, di(2-ethylhexyl) sebacate, dilauryl sebacate, di-n-hexyl fumarate, dioctyl sebacate, diisooctyl azelate, diisodecyl azelate, dioctyl phthalate, didecyl phthalate, di(eicosyl) sebacate, the 2-ethylhexyl diester of tinoleic acid dimer, and the complex ester formed by reacting one mole of sebacic acid with two moles of tetraethylene glycol and two moles of 2-ethylhexanoic acid.

Other esters which may be used include those made from $C_3$-$C_{18}$ monocarboxylic acids and polyols and polyol ethers such as neopentyl glycol, trimethylolpropane, pentaerythritol and dipentaerythritol. Trimethylol propane tripelargonate, pentaerythritol tetracaproate, the ester formed from trimethylolpropane, caprylic acid and sebacic acid, and the polyesters derived from a $C_4$-$C_{14}$ dicarboxylic acid and one or more aliphatic dihydric $C_3$-$C_{12}$ alcohols such as derived from azelaic acid or sebacic acid and 2,2,4-trimethyl-1,6-hexanediol serve as examples.

Silicon-based oils such as the polyalkyl-, polyaryl-, polyalkoxy-, or polyaryloxy-siloxane oils and silicate oils comprise another class of synthetic lubricants (e.g., tetraethyl silicate, tetraisopropyl silicate, tetra-(2-ethylhexyl) silicate, tetra-(p-tert-butylphenyl) silicate, poly(methyl) siloxanes, and poly(methylphenyl)siloxanes. Other synthetic lubricating oils include liquid esters of phosphorus-containing acids (e.g., tricresyl phosphate, trioctyl phosphate, triphenyl phosphite, and diethyl ester of decane phosphonic acid.

Also useful as base oils or as components of base oils are hydrogenated or unhydrogenated liquid oligomers of $C_6$-$C_{16}$ α-olefins, such as hydrogenated or unhydrogenated oligomers formed from 1-decene. Methods for the production of such liquid oligomeric 1-alkene hydrocarbons are known and reported in the literature. See for example U.S. Pat. Nos. 3,749,560; 3,763,244; 3,780,128; 4,172,855; 4,218,330; 4,902,846; 4,906,798; 4,910,355; 4,911,758; 4,935,570; 4,950,822; 4,956,513; and 4,981,578. Hydrogenated 1-alkene oligomers of this type are available as articles of commerce. Blends of such materials can also be used in order to adjust the viscometrics of the given base oil. As is well known, hydrogenated oligomers of this type contain little, if any, residual ethylenic unsaturation. Preferred oligomers are formed by use of a Friedel-Crafts catalyst (especially boron trifluoride promoted with water or a $C_{1-20}$ alkanol) followed by catalytic hydrogenation of the oligomer so formed using procedures such as are described in the foregoing U.S. patents.

Other catalyst systems which can be used to form oligomers of 1-alkene hydrocarbons, which, on hydrogenation, provide suitable oleaginous liquids include Ziegler catalysts such as ethyl aluminum sesquichloride with titanium tetrachloride, aluminum alkyl catalysts, chromium oxide catalysts on silica or alumina supports and a system in which a boron trifluoride catalyst oligomerization is followed by treatment with an organic peroxide.

Likewise, various proprietary synthetic lubricants such as KETJENLUBE synthetic oil of Akzo Chemicals can be employed either as the sole base lubricant or as a component of the base lubricating oil.

Typical vegetable oils that may be used as base oils or as components of the base oils include castor oil, olive oil, peanut oil, rapeseed oil, corn oil, sesame oil, cottonseed oil, soybean oil, sunflower oil, safflower oil, hemp oil, linseed oil, tung oil, oiticica oil, jojoba oil, meadowfoam oil, and the like. Such oils may be partially or fully hydrogenated, if desired.

The fact that the base oils used in the compositions of this invention may be composed of (i) one or more mineral oils, (ii) one or more synthetic oils, (iii) one or more vegetable oils, or (iv) a blend of (i) and (ii), or (i) and (iii), or (ii) and (iii), or (i), (ii) and (iii) does not mean that these various types of oils are necessarily equivalents of each other. Certain types of base oils may be used in certain compositions for the specific properties they possess such as biodegradability, high temperature stability, nonflammability or lack of corrosivity towards specific metals (e.g. silver or cadmium). In other compositions, other types of base oils may be preferred for reasons of availability or low cost. Thus, the skilled artisan will recognize that while the various types of base oils discussed above may be used in the compositions of this invention, they are not necessarily functional equivalents of each other in every instance.

Proportions

In general, the finished lubricants will contain the additive components in minor amounts sufficient to improve the performance characteristics and properties of the base oil or fluid. The amounts of the respective components may vary in accordance with such factors as the type and characteristics of the base oil or fluid employed, the type and severity of the service conditions for which the finished product is intended, and the specific performance properties desired in the finished product, such as for example the length of intended extended drain performance. However, generally speaking, the amounts used are as shown in the following table wherein amounts of components given in terms other than sulfur or phosphorus content in the oil are on an active ingredient basis, i.e., excluding diluents which often are associated therewith) in the base oils or fluids are illustrative:

| | Typical Range, wt % | Preferred Range, wt % |
|---|---|---|
| Sulfur as Component a) | 0.4–4.0 | 0.6–3.0 |
| Phosphorus as Component b) | 0.02–0.5 | 0.04–0.25 |
| Component c) | 0.05–0.6 | 0.07–0.5 |
| Component d) | 0.1–1.0 | 0.2–0.8 |
| Component e) | 0–3 | 0.1–2 |
| Component f) | 0–4 | 0.1–3 |
| Component g) | 0–0.3 | 0.0002–0.1 |
| Component h) | 0–2 | 0.1–1 |
| Component i) | 0–2 | 0.01–1.5 |

It is to be noted that some additives are multifunctional additives capable of contributing more than a single property to the blend in which they are used. Thus when employing a multifunctional additive component in the compositions of this invention, the amount used should of course be sufficient to achieve the function(s) and result(s) desired therefrom.

The individual components can be separately blended into the base oil or fluid or can be blended therein in various subcombinations, if desired. Moreover, such components can be blended in the form of separate solutions in a diluent. Another variant is to employ a so-called top treat wherein one or more components such as an alkali and/or alkali earth metal overbased component are added to the base oil separately from an additive concentrate containing other components desired in finished oil. Except for viscosity index improvers and/or pour point depressants (which in many instances are blended apart from other components), it is preferable to blend the other selected components into the base oil by use of an additive concentrate of this invention, as this simplifies the blending operations, reduces the likelihood of blending errors, and takes advantage of the compatibility and solubility characteristics afforded by the overall concentrate.

The additive concentrates of this invention will contain the individual components in amounts proportioned to yield finished oil or fluid blends consistent with the concentrations tabulated above. In most cases, the additive concentrate will contain one or more diluents such as light mineral oils, to facilitate handling and blending of the concentrate. Thus concentrates containing up to 80 % by weight of one or more diluents or solvents can be used. Recommended dosage levels for the concentrates typically fall within the range of 3.5 to 10.5 wt % based on the total weight of the finished lubricant composition. However dosage levels outside of this range can be used, if desired.

Performance

Heavy duty hypoid gear tests were conducted by a well-known OEM. In these tests direct comparisons were made of pitting performance of gears operated at an oil sump temperature of 105° C. as between an API GL-5 lubricant of this invention and the commercial premium grade API GL-5 gear lubricant theretofore selected by that OEM as the best available gear lubricant for heavy duty vehicular service. Multiple tests were performed on each lubricant. The pitting results were converted by correlations known to the OEM into average gear tooth life and normalized whereby the results on the commercial API GL-5 gear oil were equated to 100%. Thus performance of any other test lubricant if below 100% would be deemed inferior and the magnitude of the inferiority would be in terms of the percentage ascribed to that lubricant. Conversely, if the performance of the new test lubricant yields a normalized rating above 100%, the new lubricant is deemed superior to the commercial API GL-5 lubricant by the magnitude of difference between the respective percentages. In one set of these tests it was found that the lubricant of this invention gave a normalized average gear tooth life of 225% meaning that the composition of this invention more than doubled the effective life of the gears under these heavy duty conditions. This in turn means that the drainage period for the lubricant can be can be at least twice as long as that of the commercial premium gear additive package. According to the OEM, these results satisfy the need for an extended drain period, and translate into a recommended extended drain period of at least 100,000 miles of heavy duty operation. Another lubricant of this invention in similar tests was 47% more effective than the commercial premium grade GL-5 lubricant.

The substantial performance improvements made possible by the practice of this invention was further shown in an additional pair of comparative tests conducted as above except that the tests were initiated with used samples of the respective lubricants. That is, both lubricants were used as gear lubricants in runs conducted under the same conditions. Then the used oils were subjected to the above heavy duty gear pitting tests and the normalized results were compared. It was found that the used lubricant of this invention gave a 60% increase in projected gear tooth life as compared to the used oil that contained the commercial premium gear additive package. This again shows the greater effectiveness and longer periods of effective gear protection made possible by this invention.

Another test procedure was used in order to evaluate oil performance on planetary gears under heavy duty conditions. The rig used includes a system of spur gears driven under variable and very heavy loads. The lubricant is circulated around the system by a pump without any temperature control, in order to measure the actual temperatures developed during operation of the rig on a given test cycle for 6 hours. Prior to each series of tests new test pieces are broken in by operating the rig with a commercial gear oil. Then the 6-hour test is conducted with the lubricant under test. During the test the temperatures developed in the oil are continuously measured and recorded. It was found that SAE 90 and SAE 80W90 mineral oil based lubricants of this invention and a 75W90 synthetic oil based lubricant of this invention, each containing 7.5 wt % of an additive package of this invention, gave oil temperatures that were substantially lower than the temperatures produced with an SAE 90 mineral oil containing the above commercial API GL-5 premium gear oil package. Throughout the entire test period the mineral oil based composition of this invention ran about 10 to 12 centigrade degrees cooler than the oil with the commercial package. And throughout the 6-hour test period the synthetic oil based composition of this invention ran about 20 centigrade degrees cooler than the oil with the commercial package. These temperature differentials translate into less gear stress and longer periods of successful operation before recommended oil change.

Similar planetary gear tests were run for longer periods of time without oil temperature regulation. In this case the mineral base oils containing the respective additive packages were run for a 50-hour period and thereupon the temperatures of the respective sump oils were measured during the next 80 minutes of operation. The lubricant of this invention again ran about 20 centigrade degrees cooler throughout the entire 80-minute period than the oil with the commercial package.

Comparative tests in the same rig were also conducted wherein the amount of phosphorus remaining in solution in the oil was measured throughout a prolonged test period. Both test oils initially contained 0.12 wt % phosphorus. After over 190 hours of operation the mineral oil based composition of this invention was found to contain about 0.10 wt % phosphorus. On the other hand, the mineral oil containing the commercial package had phosphorus levels of less than 0.08 wt % after only about 25 hours of operation, about 0.05 wt % after about 90 hours of operation, and about 0.04 wt % at 170 hours of operation at which point the test was discontinued.

The extent of wear during operation of the planetary rig was also studied. These operations compared the time required for a sharp rise in the iron content of the oil. In this case oil with the commercial API GL-5 package exhibited a sharp rise in iron content after about 130 hours of operation. The lubricant of this invention did not experience a sharp rise in iron content until about 155 hours of operation.

Further studies in the planetary rig showed that the amount of energy required to operate the rig with the oil containing the package of this invention throughout a period of about 170 hours was approximately 14% less than the amount of energy required to operate the rig with the oil containing the commercial API GL-5 package. These results thus demonstrate that improved fuel economy can be achieved by use of the lubricant compositions of this invention in the gear box.

We claim:

1. A method of inhibiting pitting and enhancing tooth life of gears in a gear box or axle of a vehicle which comprises introducing into the gear box or axle a gear oil comprising at least one oil of lubricating viscosity and at least the following additive components:

a) at least one oil-soluble, metal-free, sulfur-containing antiwear and/or extreme pressure agent having a copper corrosion test activity of not more than 65, wherein the gear oil contains from 0.6 to 3.0 wt % of sulfur;

b) at least one oil-soluble metal free, phosphorus-and nitrogen-containing antiwear and/or extreme pressure agent, wherein the gear oil contains from 0.04 to 0.25 wt % of phosphorus;

c) from 0.07 to 0.50 wt % of at least one oil-soluble organic carboxylic acid; and d) from 0.2 to 0.8 wt % of at least one oil-soluble organic amine, and keeping that gear oil therein as the gear lubricant therefor for the period of service recommended or specified by the manufacturer of the vehicle.

2. A method of inhibiting pitting and enhancing tooth life of gears in a transmission, gear box or axle of a vehicle designed for heavy duty service which comprises introducing into the gear box or axle as the gear lubricant therefor, a gear oil comprised of at least one oil of lubricating viscosity and at least the following additive components:

a) at least one oil-soluble metal-free sulfur-containing antiwear and/or extreme pressure agent having a copper corrosion test activity of not more than 65, wherein the gear oil contains from 0.6 to 3.0 wt % of sulfur;

b) at least one oil soluble metal free phosphorus-and nitrogen-containing antiwear and/or extreme pressure agent where the gear oil contains from 0.04 to 0.25 wt % of phosphorus comprising (i) at least one amine salt of a dihydrocarbyl monothiophosphoric acid or (ii) at least one amine salt of a hydrocarbyl phosphoric acid, or both (i) and (ii);

c) from 0.07 to 0.50 wt % of at least one aliphatic oil-soluble organic monocarboxylic acid having in the range of 6 to 24 carbon atoms per molecule; and d) from 0.2 to 0.8 wt % of at least one aliphatic oil-soluble organic primary monoamine having in the range of 6 to 24 carbon atoms per molecule and maintaining that gear oil therein for a total of at least 100,000 miles of vehicle operation.

* * * * *